US005787670A

United States Patent [19]

Muncy

[11] Patent Number: 5,787,670

[45] Date of Patent: Aug. 4, 1998

[54] BUILDING BLOCK WITH INTEGRAL HAND HOLD AND METHOD FOR MAKING SAME

[76] Inventor: Dennis Muncy, 202 W. Main St., Knightstown, Ind. 46148

[21] Appl. No.: 678,156

[22] Filed: Jul. 11, 1996

[51] Int. Cl.[6] ..... E04C 1/10

[52] U.S. Cl. ..... 52/607; 52/606; 52/DIG. 1; 52/749.14; 405/284; 446/102

[58] Field of Search ..... 52/606, 607, 608, 52/DIG. 1, 749.14, 749.13; 405/284, 285, 286; 446/102, 104, 108

[56] References Cited

U.S. PATENT DOCUMENTS

| | | | |
|---|---|---|---|
| 786,250 | 3/1905 | Dunham | 52/606 X |
| 1,365,825 | 1/1921 | Green | 52/606 |
| 1,529,317 | 3/1925 | Ludeman | 52/606 X |
| 1,567,430 | 12/1925 | Eberling . | |
| 1,886,404 | 11/1932 | Kipple . | |
| 2,493,547 | 1/1950 | Paolella et al. | 52/606 X |
| 2,611,261 | 9/1952 | Preston | 52/603 X |
| 5,421,135 | 6/1995 | Stevens et al. | 52/604 |
| 5,537,796 | 7/1996 | Kliethermes, Jr. | 52/606 X |

FOREIGN PATENT DOCUMENTS

| | | | |
|---|---|---|---|
| 552917 | 5/1923 | France | 52/607 |
| 677668 | 3/1930 | France | 52/606 |

*Primary Examiner*—Carl D. Friedman
*Assistant Examiner*—Winnie Yip
*Attorney, Agent, or Firm*—Woodard, Emhardt, Naughton Moriarty & McNett

[57] ABSTRACT

A building block with integral hand hold and a method for making same. As with standard prior art masonry blocks, the building block of the present invention includes a central transverse web which provides structural rigidity to the block and divides the interior space of the block into two substantially equal sized areas. However, the building block of the present invention includes a cut-out completely through the central transverse web which facilitates placement of a mason's fingers therein in order to grasp and lift the block. A preferred method for making the blocks includes the use of a mold which allows the transverse web to be formed with the rest of the block, with the central cut-out then being punched out of the transverse web prior to kiln drying the block.

3 Claims, 4 Drawing Sheets

BUILDING BLOCK WITH INTEGRAL HAND HOLD AND METHOD FOR MAKING SAME

TECHNICAL FIELD OF THE INVENTION

The present invention generally relates to building masonry blocks and, more particularly, to a building block with integral hand hold and method for making same.

BACKGROUND OF THE INVENTION

Building blocks, such as concrete blocks, hollow tile, bricks and the like, which may be made, for example, from concrete, clay, terra cotta, plaster, or other materials, are common in the building trade. The most common use for such materials is the construction of masonry walls, wherein adjacent blocks are coupled together by means of mortar applied with a trowel. Because such building blocks are the main structural elements of the masonry wall, they are by necessity of a fairly large size and substantial weight. This presents a problem during construction of the wall due to the fact that the mason must grip the blocks by squeezing his fingers on either side of the central web while lifting and placing the block. This requires the mason to squeeze on the central web of the block with a force greater than the weight of the block in order to keep the block from slipping from his hand. Such repeated gripping of block after block while building a wall causes great strain on the mason's hand and arm muscles.

There have been attempts in the prior art to incorporate a handle into the building block design which would enable the mason to more readily lift the blocks. However, all such attempts in the prior art have been unsuccessful. For example, U.S. Pat. No. 1,567,430 to Eberling discloses a building block having a pair of hand holds which are separated by a handle web. Because the handle of Eberling weakens the structure of the building block, it is necessary for this design to further incorporate transverse webs within the block in order to provide structural rigidity. Not only is this design more expensive to manufacture due to the increase of raw material in order to form the extra transverse webs, but the increased mating surface area between adjacent blocks requires a greater quantity of mortar to be applied between adjacent blocks. Therefore, the cost of building a masonry wall with such blocks is significantly greater than with standard blocks. Consequently, the widespread use of standard blocks without hand holds still prevails.

Similarly, U.S. Pat. No. 5,421,135 to Stevens et al. discloses a building block design which includes an integral hand hold. However, as with the Eberling reference discussed above, elimination of the central transverse web of the building block in order to provide for the hand hold results in structural weakening of the block, requiring the Stevens design to include two rather substantial protrusions projecting from either end of the block into the central interior cavity. However, as with the Eberling design, these protrusions result in a greater amount of material being required to make each block, thereby increasing their cost.

There is therefore a need in the prior art for a building block which includes an integral hand hold, but which does not require any substantially greater amount of raw material in its manufacture. The present invention is directed toward meeting this need.

SUMMARY OF THE INVENTION

The present invention relates to a building block with integral hand hold and a method for making same. As with standard prior art masonry blocks, the building block of the present invention includes a central transverse web which provides structural rigidity to the block and divides the interior space of the block into two substantially equal sized areas. However, the building block of the present invention includes a cut-out completely through the central transverse web which facilitates placement of a mason's fingers therein in order to grasp and lift the block. A preferred method for making the blocks includes the use of a mold which allows the transverse web to be formed with the rest of the block, with the central cut-out then being punched out of the transverse web prior to kiln drying the block.

In one form of the invention a building block is disclosed, comprising first, second, third and fourth walls coupled together to form a substantially rectangular block having a top surface, a bottom surface, and first, second, third and fourth inside surfaces; and a transverse web substantially bisecting an interior of the rectangular block, the transverse web extending from the first inside surface to the second inside surface and from the top surface to the bottom surface; wherein the transverse web includes a cut-out therethrough such that portions of the transverse web are positioned both above and below the cut-out.

In another form of the invention a method of forming a building block is disclosed, comprising the steps of: (a) providing a mold having an interior space defining first, second, third and fourth walls coupled together to form a substantially rectangular block and a transverse web substantially bisecting an interior of the rectangular block; (b) filling the interior space with a building block material; and (c) punching a cut-out through the transverse web prior to solidification of the building block material.

In another form of the invention a mold for forming a building block is disclosed, the mold comprising an exterior mold having an interior space defining a substantially rectangular block; and an interior mold coupled to the exterior mold, the interior mold including first and second spacers, wherein a space between the first and second spacers and the exterior mold defines first, second, third and fourth walls coupled together to form a substantially hollow rectangular block and a transverse web substantially bisecting an interior of the hollow rectangular block; wherein the first spacer comprises an opening adjacent a first side of the transverse web; and wherein the second spacer comprises a punching die adjacent a second side of the transverse web, the punching die * operative to punch through the transverse web toward the opening.

DETAILED DESCRIPTION OF THE PREFERRED EMBODIMENT

Figure 1:
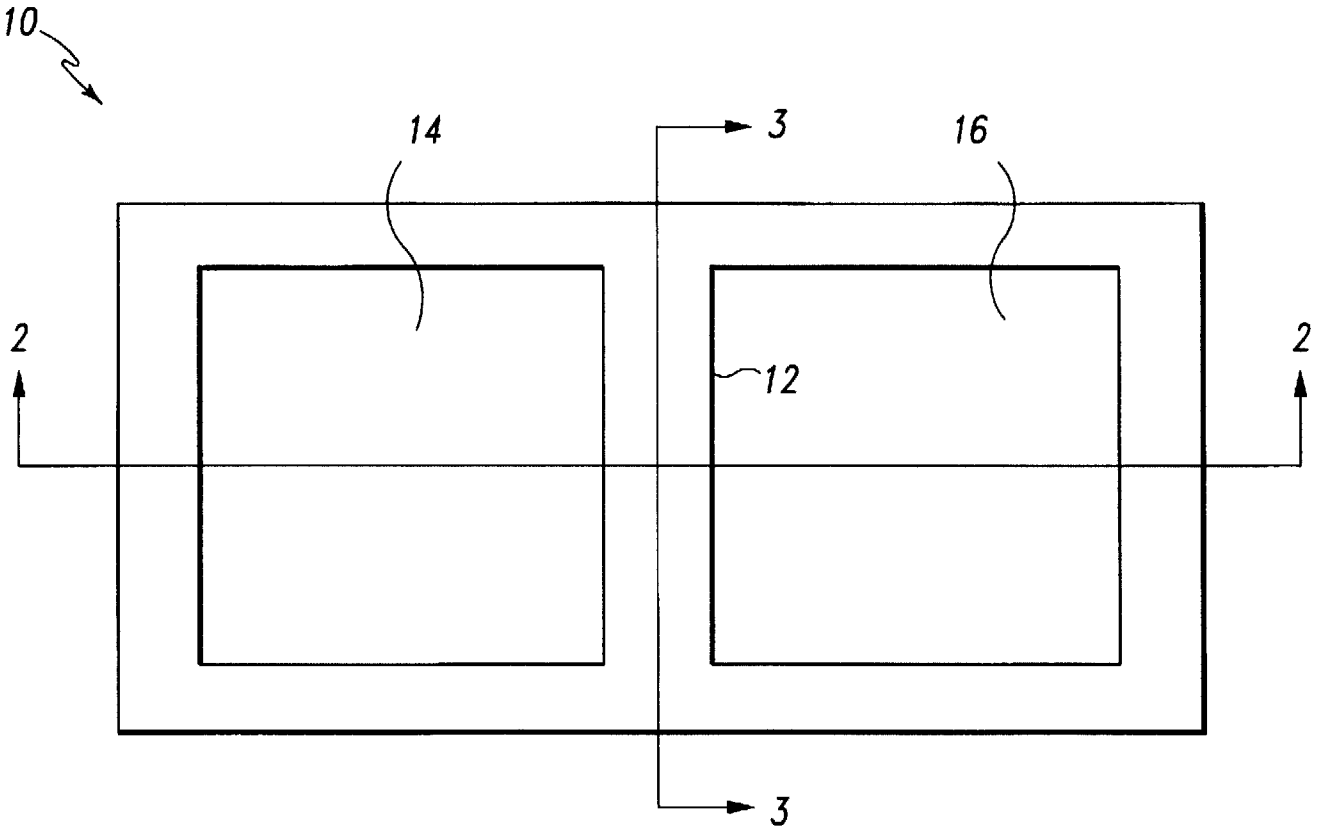
FIG. 1 is a top plan view of a first embodiment building block of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention allows for the formation of a masonry block having a standard configuration (i.e. generally rectangular in shape and having a transverse central web which divides the interior space of the building block into two substantially equal chambers) while still providing for an integral hand hold which will provide a handle for a mason to lift the block. Because the building block of the present invention maintains the central transverse web, no further structural modifications are necessary in order to provide the required structural integrity. The building block of the present invention therefore does not require more raw materials in its manufacture than the standard masonry block and in fact requires less material. The building block of the present invention may therefore be constructed at a cheaper unit cost than even the standard masonry block in current widespread use.

Figure 2:
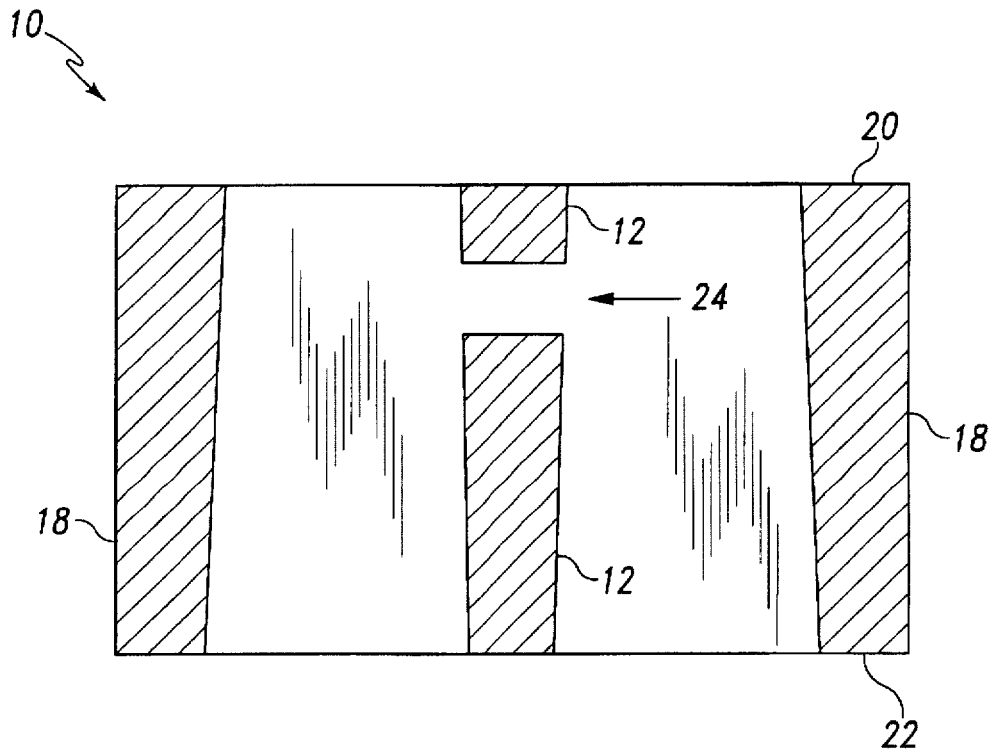
FIG. 2 is a first side cross sectional view of the first embodiment building block of the present invention.
Figure 3:
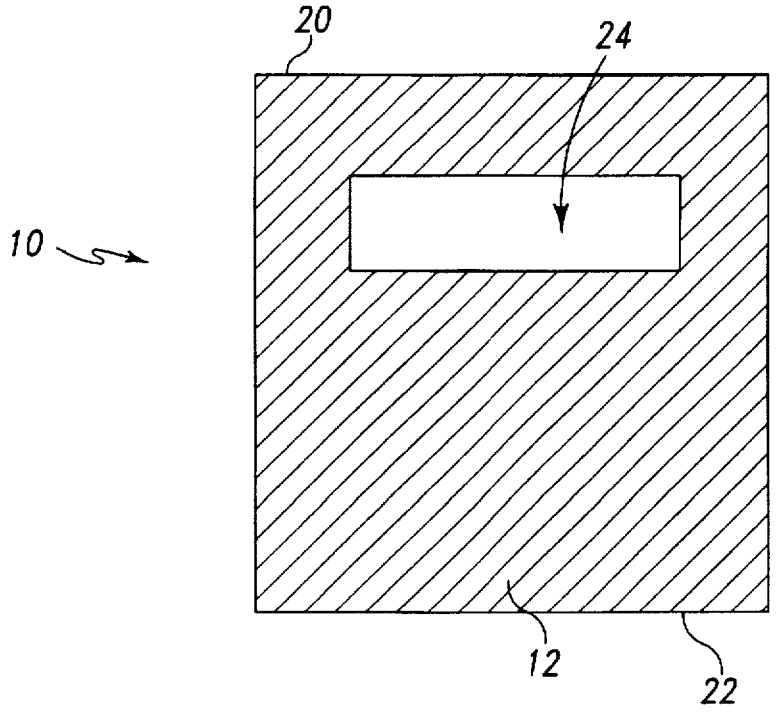
FIG. 3 is a second side cross sectional view of the first embodiment building block of the present invention, taken through the central transverse web.

Referring now to FIG. 1, a first embodiment building block of the present invention is illustrated in a top plan view, and indicated generally at 10. The block 10 has a transverse web 12 which divides the interior of the block 10 into two substantially equal chambers 14 and 16. The block 10 is illustrated in a longitudinal cross-section in FIG. 2. The outer walls 18 of the block 10 as well as the transverse web 12, preferably taper from top to bottom, such that the top surface 20 of the block 10 has a larger surface area than the bottom surface 22 of the block 10. A cut-out 24 is formed completely through the central transverse web 12, preferably between the center of the web 12 and the top surface 20 of the block 10. The cut-out 24 is visible in the transverse cross-sectional view of FIG. 3.

Provision of the cut-out 24 transforms the portion of the central web 12 above the cut-out 24 into a convenient handle which may be gripped by a mason when moving the block 10. The cut-out 24 is placed near enough to the top of the block 10 such that it is convenient for the mason's fingers to be inserted through the cut-out 24 and wrapped around the top section of the central web 12. Furthermore, by maintaining the central web 12 intact with the exception of the cut-out 24, the block 10 continues to exhibit sufficient structural rigidity such that no further structural modifications are necessary to the block 10. This means that the block 10 requires an even smaller amount of raw material in its construction than does the standard prior art masonry block which does not include the cut-out 24. The block 10 is illustrated in a partial cut-away perspective view in FIG. 4.

Figure 4:
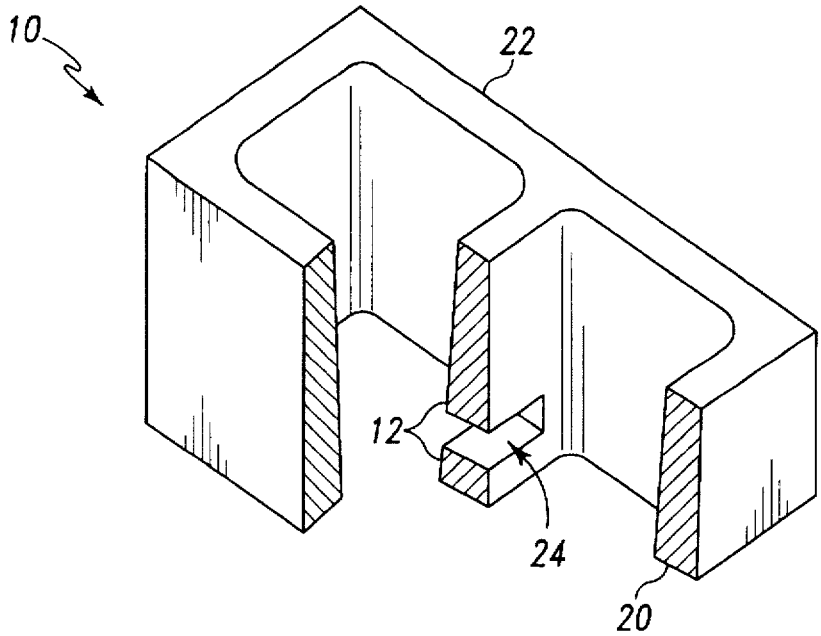
FIG. 4 is a cut-away perspective view of the first embodiment building block of the present invention.
Figure 5:
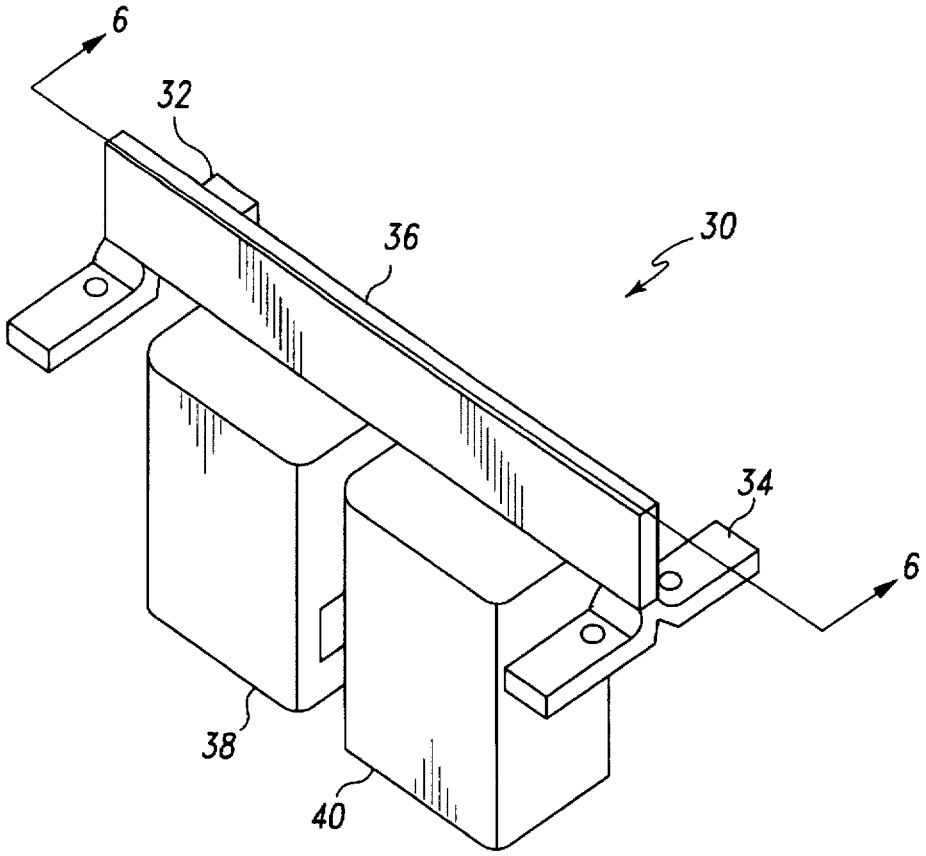
FIG. 5 is a perspective view of a first embodiment mold insert for use in forming the building block of the present invention.

The building block 10 is illustrated in an inverted position in FIG. 4 because this is the orientation in which the block 10 is manufactured. An exterior rectangular mold (not shown) is constructed which defines the outside dimensions of the block 10. As illustrated in FIG. 5, a mold insert 30 is attached to the exterior mold in order to provide the mold for the interior cavities 14 and 16 of the block 10. The mold insert 30 is attached to the exterior mold by means of the arms 32 and 34 with appropriate mounting hardware. A cross brace 36 couples the arms 32 and 34. Interior cavity molds 38 and 40 are mounted to the cross brace 36 such that they extend into the interior of the exterior mold of the concrete block 10. The spaces between the interior cavity molds 38 and 40 and the exterior mold are then filled with the raw material from which the block 10 is constructed. Once the material has been poured into the mold, it is typically vibrated and compacted in order to ensure that the material is evenly distributed throughout the block 10.

Figure 6:
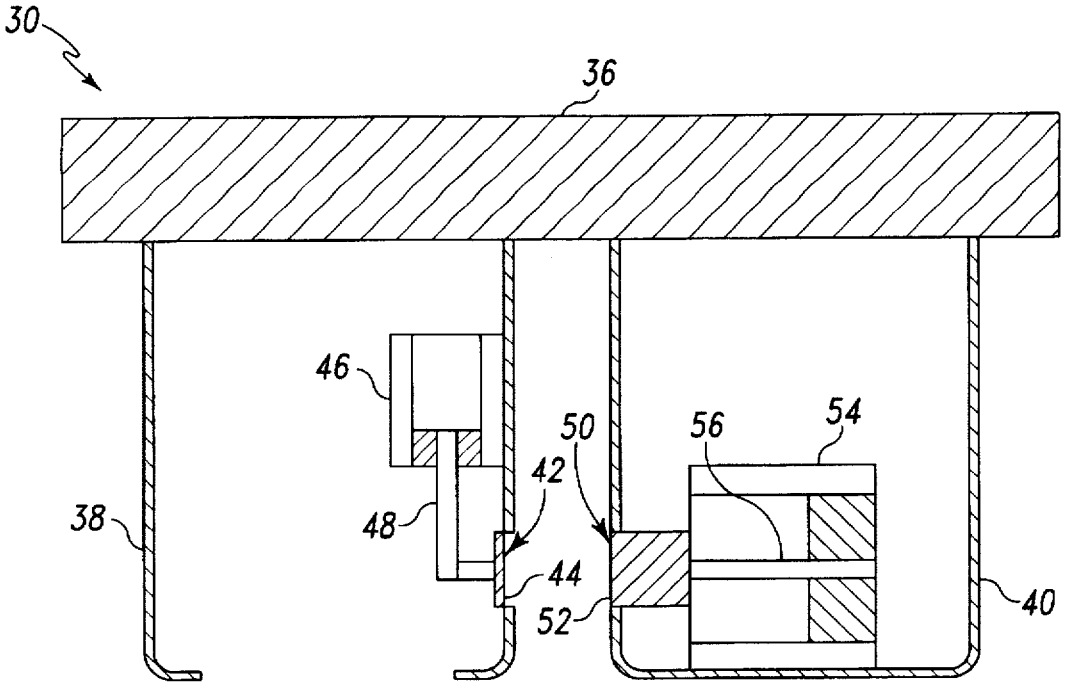
FIG. 6 is a side cross-sectional view of the mold insert of FIG. 5 illustrating the punching die in a retracted position.
Figure 7:
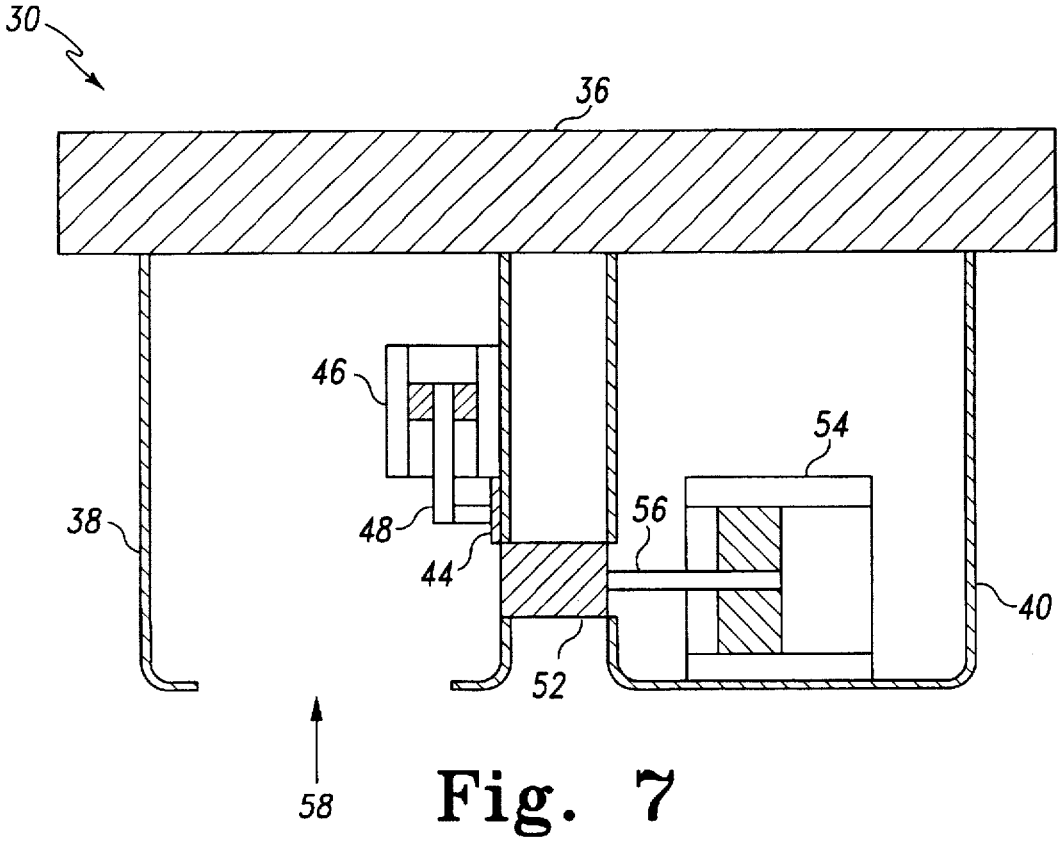
FIG. 7 is a side cross-sectional view of the mold insert of FIG. 5 illustrating the punching die in an extended position.

Referring now to FIGS. 6 and 7, the mold insert 30 is illustrated in a cross-sectional view. As illustrated in the figures, the interior cavity molds 38 and 40 are substantially hollow. The interior cavity mold 38 includes an opening 42 therein which faces the area occupied by the central web 12. The opening 42 is the same size and shape as the cut-out 24. When the raw material is initially poured into the mold, the opening 42 is completely covered by a sliding door 44. The door 44 is operative to slide in a vertical direction by means of a linear actuating mechanism 46 which is coupled thereto by means of an appropriate coupling 48. The linear actuating mechanism 46 may be any device which produces controllable linear motion of the coupling 48, and hence the sliding door 44. For example, the mechanism 46 may be an electric solenoid, a pneumatic solenoid, a hydraulic solenoid, a stepper motor and screw spindle arrangement, or any other such device which produces the desired controllable motion. The linear actuating mechanism 46 is coupled to the interior surface of the interior cavity mold 38.

Similarly, the interior cavity mold 40 includes an opening 50 which is adjacent the central web 12 and sized and shaped to correspond to the cut-out 24. When the raw material is initially poured into the mold, the opening 50 is closed by a punching die 52. The punching die 52 is coupled to a second linear actuating mechanism 54 which is attached to the interior surface of the interior cavity mold 40. The coupling is by means of any suitable coupling 56. The linear actuating mechanism 54 may be any device which produces the required controllable linear motion, as described above with respect to the linear actuating mechanism 46.

With particular reference now to FIG. 7, after the raw material has been poured into the mold and compacted, the first and second linear actuating mechanisms 46 and 54 are operated in sequential motions such that the door 44 is slid away from the opening 42 and the punching die 52 is extended from the opening 50 until it reaches the opening 52. Note that this requires the punching die 52 to be wide enough to extend substantially completely between the interior cavity molds 38 and 40. The result of the coordinated motions between the linear actuating mechanisms 46 and 54 is that the material between the interior cavity molds 38 and 40 which occupied the space where cut-out 24 is to be formed is pushed into the interior of the cavity mold 38. The cavity mold 38 preferably includes a bottom opening 58 which allows for eventual expulsion of the displaced material. The mold is then left in this position during the kiln drying process which produces the finished building block 10. The linear actuating mechanisms 46 and 54 may then be reversed to their positions as illustrated in FIG. 6, so that the mold insert 30 may be removed from the interior of the building block 10.

It will be appreciated by those skilled in the art that the equipment used to form the prior art masonry building block is already under computer control and includes pneumatic lines which are used to generate desired motions. The coupling of the mold insert 30 of the present invention to such a control system is therefore considered to be well within the skill of one having ordinary skill in the art. It will be further appreciated by those skilled in the art that by providing the cut-out 24 in the transverse web 12 of the building block 10, provision may be made for a convenient gripping sight for the mason's hand without destroying the structural integrity of the standard prior art masonry block. Because of this, no further structural modifications are necessary to the block which would require the use of more raw material when constructing the block. As a result, the building block 10 of the present invention has a lower variable manufacturing cost than does the standard prior art masonry building block.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A building block, comprising:

first, second, third and fourth walls formed together to form a substantially rectangular block having a top surface, a bottom surface, and first, second, third and fourth inside surfaces;

a transverse web substantially bisecting an interior of the rectangular block, the transverse web extending from the first inside surface to the second inside surface and from the top surface to the bottom surface; and a cut-out formed through the transverse web such that portions of the transverse web are positioned both above and below the cut-out, the cut-out including upper and lower edges;

wherein the upper and lower edges of the cut-out are substantially straight and substantially parallel to the top and bottom surfaces of the block in order to facilitate gripping of the portion of the transverse web positioned above or under the cut-out from either the top and the bottom surfaces of the block with a user's hand.

2. The building block of claim 1, wherein the first, second, third and fourth walls and the transverse web are formed from concrete.

3. The building block of claim 1, wherein the first, second, third and fourth walls and the transverse web exhibit greater thickness at the top surface than at the bottom surface.

* * * * *

UNITED STATES PATENT AND TRADEMARK OFFICE

CERTIFICATE OF CORRECTION

PATENT NO. : 5,787,670

DATED : August 4, 1998

INVENTOR(S) : Dennis Muncy

It is certified that error appears in the above-identified patent and that said Letters Patent is hereby corrected as shown below:

In column 2, line 46, please delete "*"

In column 6, line 11, please insert --the-- before "bottom".

Signed and Sealed this

Twenty-first Day of September, 1999

*Attest:*

Q. TODD DICKINSON

*Attesting Officer*

*Acting Commissioner of Patents and Trademarks*